US008701528B2

(12) United States Patent
Wu

(10) Patent No.: US 8,701,528 B2
(45) Date of Patent: Apr. 22, 2014

(54) RATCHET-ACTION OPEN-END WRENCH

(75) Inventor: Arthur Wu, Taichung (TW)

(73) Assignee: Proxene Tools Co., Ltd., Taichung (TW)

( * ) Notice: Subject to any disclaimer, the term of this patent is extended or adjusted under 35 U.S.C. 154(b) by 298 days.

(21) Appl. No.: 13/225,138

(22) Filed: Sep. 2, 2011

(65) Prior Publication Data

US 2013/0055859 A1 Mar. 7, 2013

(51) Int. Cl.
*B25B 13/18* (2006.01)

(52) U.S. Cl.
USPC ..... 81/179; 181/126

(58) Field of Classification Search
USPC ..... 81/179, 186, 126, 111, 97, 128
See application file for complete search history.

(56) References Cited

U.S. PATENT DOCUMENTS

| | | | | |
|---|---|---|---|---|
| 949,557 | A * | 2/1910 | Whetzel | 81/179 |
| 4,637,284 | A | 1/1987 | Rosenbaum | |
| 5,287,777 | A | 2/1994 | Kolodziej | |
| 5,582,082 | A | 12/1996 | Gajo | |
| 7,827,887 | B2 | 11/2010 | Lee | |
| 7,878,095 | B2 * | 2/2011 | Wu | 81/179 |
| 8,342,063 | B2 * | 1/2013 | Stanton | 81/179 |

* cited by examiner

*Primary Examiner* — Hadi Shakeri
(74) *Attorney, Agent, or Firm* — Muncy, Geissler, Olds & Lowe, P.C.

(57) ABSTRACT

A ratchet-action open-end wrench of the present invention has a simplified structure. Arc-shaped abutting surface and corresponding groove is dismissed from the present wrench. Thus, components of the wrench can be manufactured and fabricated easily, and specified producing process can be chosen for obtaining strengthened structure. In addition, cost of the wrench is abated, precision of the wrench is arisen, and lift-time of the wrench is prolonged.

18 Claims, 7 Drawing Sheets

RATCHET-ACTION OPEN-END WRENCH

BACKGROUND OF THE INVENTION

1. Field of the Invention

The present invention relates to a ratchet-action open-end wrench.

2. Description of the Prior Art

Conventional ratchet-action open-end wrench, as shown in U.S. Pat. No. 4,637,284, has a fixed jaw, a movable jaw which is able to slide linearly, and an elastic member. In an operation condition, user can pull the wrench back and forth. The movable jaw is able to reciprocate with respect to the fixed jaw. Thus, the movable jaw can clutch threaded member along only a predetermined direction, so that the threaded member is rotated along the predetermined direction. The threaded member would be released and would rotate with respect to the wrench when the wrench is pulled along the opposite direction. Threaded member can be detached or fastened easily.

However, the wrench mentioned above is not suitable for being used in a narrowed environment. Moving direction of the movable jaw is simply aimed away from the fixed jaw, even away from handle of the wrench. Considerable movement of the movable jaw is necessary for releasing the threaded member. Thus, the movable jaw would probably blocked by other objects, especially in narrowed environment, failing to move and to release the threaded member.

For the requirement of operation in narrowed space, wrenches are provided in several patents, such as U.S. Pat. Nos. 5,287,777, 5,582,082, and 7,827,887. These wrenches are suitable to be used in narrowed space, providing ratchet-action function. The wrench revealed in U.S. Pat. No. 5,287,777 is similar to the wrench revealed in U.S. Pat. No. 7,827,887. The movable jaws of the wrenches are slidable along a segmental pathway which is defined and limited by a pin, an arc-shaped hole, and several arc-shaped surfaces. Thus, the movable jaw is unable to rotate arbitrarily. The other wrench shown in U.S. Pat. No. 5,582,082 is provided with a pin and a linear extended hole, so that movable jaw of the wrench is able to slide. Further, both of movable jaw and fixed jaw of the wrench is formed with an arc-shaped surface. The arc-shaped surfaces are used for limiting sliding pathway of the movable jaw, so that the movable jaw can only slide with respect to the fixed jaw. The wrenches mentioned above are suitable for narrowed space, being welcomed in the market.

However, the wrenches are difficult to be produced. The components of the wrenches should be formed with several specific contours, especially arc-shaped surfaces, some of which are located in grooves. The arc-shaped surfaces are necessary for keeping the movable jaw in the predetermined pathway. The arc-shaped surfaces are very difficult to be machined or processed. For instance, the arc-shaped surface of the wrench described in U.S. Pat. No. 7,827,887 is located at an interior side of opening of the wrench. Machining tool, such as milling cutter, can hardly move into the opening. Thus, machining is obstructed.

For producing the wrenches, precision casting may be chosen as a main process. However, this would lead to a deterioration of quality of the wrench since precision casting is always accompanied with deficiencies about structure strength and surface precision. With lowered structure strength, the wrench would be unwelcomed in strict operation condition. With lowered surface precision, movement of movable jaw of the wrench would be obstructed by dust. On the other hand, precision casting would bring the manufacturing cost high. Market competitiveness of the wrenches would be probably destroyed by the disadvantages mentioned above.

The present invention is, therefore, arisen to obviate or at least mitigate the above mentioned disadvantages.

SUMMARY OF THE INVENTION

The main object of the present invention is to provide another ratchet-action open-end wrench which can be machined easily.

To achieve the above and other objects, a ratchet-action open-end wrench of the present invention includes a main body, a working portion, a slidable mechanism, and an elastic member.

Said main body has a handle, at least a head portion, and a fixed jaw. The head portion is connected to one end of the handle. The fixed jaw extends and protrudes out from the head portion.

Said working portion has at least a connection arm and a movable jaw. The connection arm abuts against the head portion. An opening is defined by the movable jaw and the fixed jaw.

Said slidable mechanism comprises a sliding groove and a sliding portion. The sliding groove is formed on one of the head portion and the connection arm. The sliding portion is firmly disposed on the other one of the head portion and the connection arm. The sliding portion is slidably disposed on the sliding groove, so that the working portion is able to slide along the sliding groove with respect to the main body. The working portion is slidable between a first position and a second position. A width of the opening is minified when the working portion slides toward the first position. The sliding groove is arc-shaped. An arc center of the sliding groove is located out of the head portion. The main body is located between the arc center and the movable jaw. The sliding portion has a non-circular cross section, so that the sliding portion is unable to rotate in the sliding groove arbitrarily.

Said elastic member abuts against the main body and the working portion, so that the working portion has a tendency to slide toward the first position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIG. 1 to FIG. 4 for a first embodiment of the present invention. The ratchet-action open-end wrench of the present embodiment has an opening which is provided for clamping threaded member, such as screw, nut, or other similar component. User can pull the wrench back and forth. The wrench would drive the threaded member to rotate along a single direction so as to detach or fasten the threaded member. In the present embodiment, the wrench includes a main body 1, a working portion 2, a slidable mechanism 3, and an elastic member 4.

Figure 1:
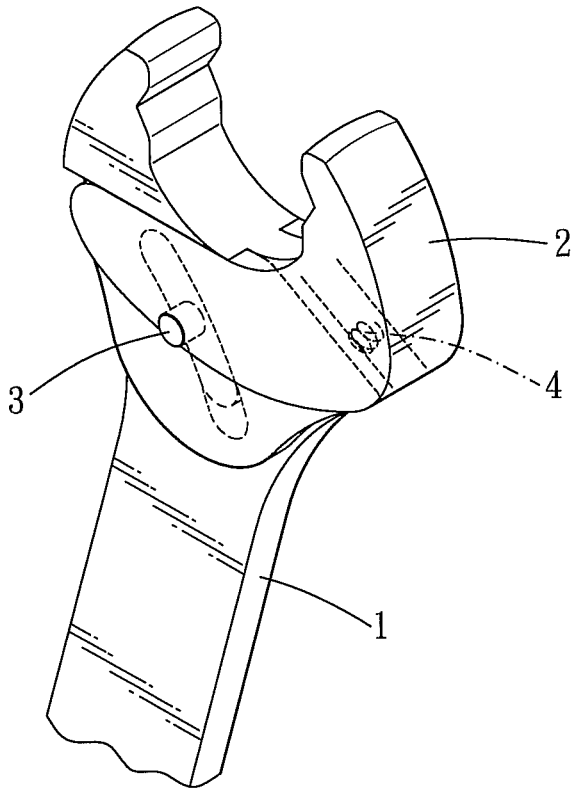
FIG. 1 is a stereogram showing a first embodiment of the present invention.
Figure 2:
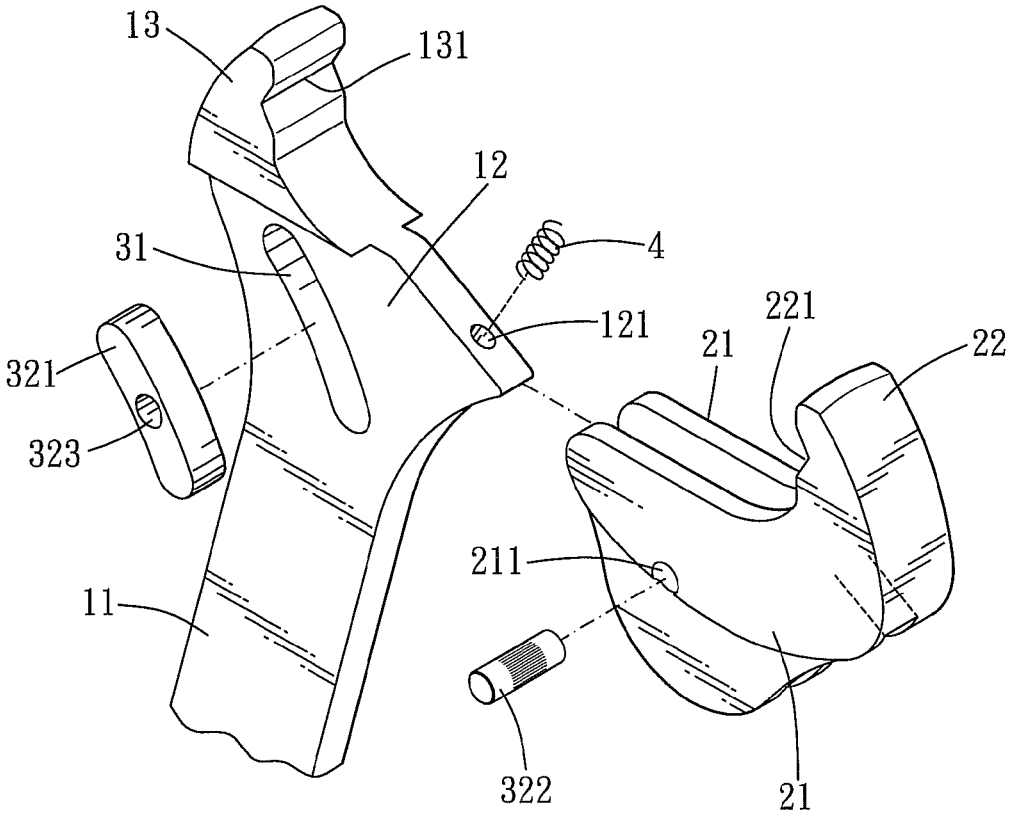
FIG. 2 is a breakdown drawing showing a first embodiment of the present invention.
Figure 3:
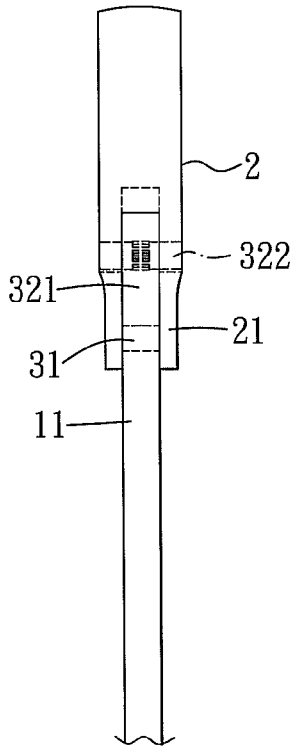
FIG. 3 is a side view showing a first embodiment of the present invention.

The main body 1 has a handle 11, a head portion 12, and a fixed jaw 13. The head portion 12 is connected to one end of the handle 11. The fixed jaw 13 extends and protrudes out from the head portion. Thus, the head portion 12 connects the handle 11 to the fixed jaw 13. For purposes of handling or storing, handling bar or hanging hole may be disposed on one end of the handle 11, where is away from the head portion 12. The fixed jaw 13 may be further formed with a recess 131. The head portion 12 is formed with a receiving groove 121. Thickness of the fixed jaw 13 may be greater than thickness of the head portion 12. Thus, the main body 1 can be formed with two step surfaces on two sides of the main body 1, as shown in FIG. 2 and FIG. 3. The step surfaces are located between the fixed jaw 13 and the head portion 12. In some embodiments, it is also possible that the main body is formed with single step surface on one side of the main body.

Figure 4:
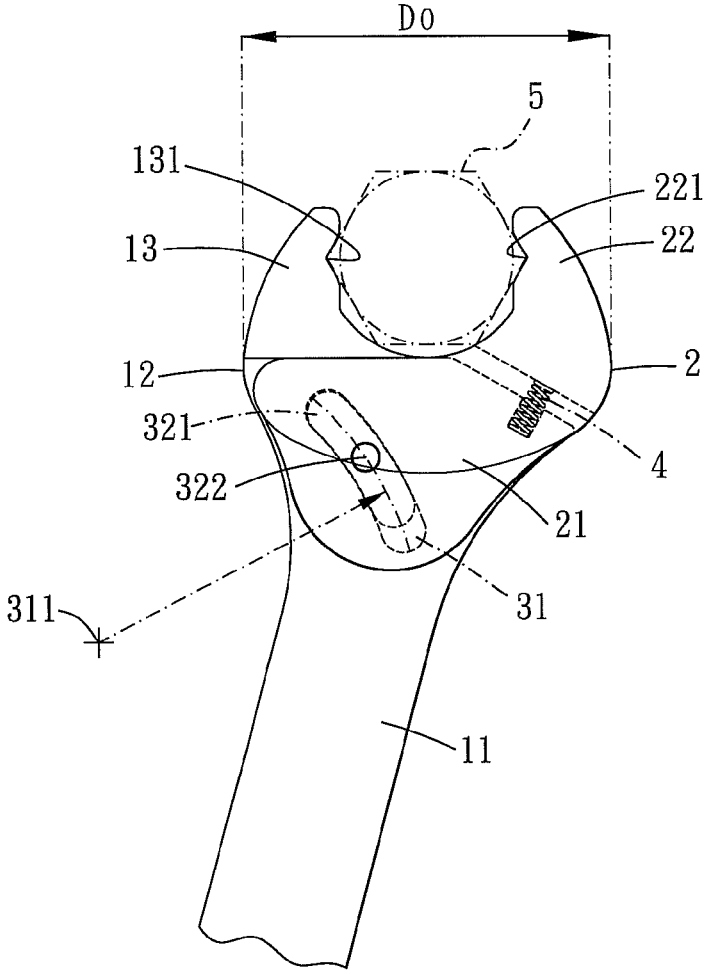
FIG. 4 is a front view showing a first embodiment of the present invention.

The working portion 2 has two connection arms 21 and a movable jaw 22, as shown in FIG. 2 and FIG. 3. The connection arms 21 abut against the head portion 12. The head portion 12 is located between the two connection arms 21. The movable jaw 22 is connected to the connection arms 21. The movable jaw 22 and the fixed jaw 13 are facing each other so as to define the opening therebetween. The movable jaw 22 may formed with the other recess 221. The recess 221 of the movable jaw and the recess 131 of the fixed jaw are facing each other. Thus, the recesses 221, 131 are able to clamp corners of a polygonal column of a threaded member 5, as shown in FIG. 4. Each of the connection arms 21 is formed with a fixation hole 211.

In the present embodiment, the working portion 2 has two connection arms 21 so as to clip the head portion 12 therein. Dust or debris would be blocked out by the connection arms 21 so as to keep motion of the head portion 12 and the connection arms 21 smooth. In some embodiments, the working portion may have only one connection arm. The main body has two head portion correspondingly. Thus, connection arm can be positioned between the two head portion, obtaining similar dust-proof effect.

The slidable mechanism 3 includes a sliding groove 31 and a sliding portion. The sliding groove 31 is formed on the head portion 12. The sliding portion is firmly disposed on the connection arms 21. More particularly, the sliding portion includes a sliding member 321 and a fixation pin 322. The sliding member 321 is slidably received in the sliding groove 31. The sliding member 321 is formed with an aperture 323. The fixation pin 322 penetrates through the aperture 323 and is received in fixation holes 211 of the connection arms 21. It should be noted that the fixation pin 322 should be unable to rotate with respect to the sliding member 321 and the connection arms 21. The fixation pin 322, the aperture 323, and the fixation holes 211 may be formed with non-circular cross section if necessary. Thus, the sliding portion is slidably disposed on the sliding groove 31. The working portion 2 is able to slide along the sliding groove 31 with respect to the main body 1. The sliding member 321 is formed in arc-shaped, so that the sliding portion has a non-circular cross section. The sliding portion is unable to rotate in the sliding groove 31 arbitrarily. The sliding groove 31 extends and is formed arc-shaped. Arc center 311 of the sliding groove 31 is located out of the head portion 12, as shown in FIG. 4. Further, the movable jaw 22 is located at right side of the main body 1, and the arc center 311 is located at left side of the main body 1. In other words, the movable jaw 22 and the arc center 311 are located at opposite sides divided by the main body 1. Thus, width of the opening would be changed when the working portion 2 and the movable jaw 22 move along the sliding groove together with the sliding portion.

It should be noted that the sliding portion is still able to rotate in a universal aspect since the sliding groove 31 is arc-shaped. However, the rotation caused by sliding along the sliding groove 31 is ignored here. Rotation of the sliding portion discussed above is rotation of the sliding portion with respect to the sliding groove. Unable to rotate of the sliding portion with respect the sliding groove should not be regarded as that the sliding portion is unable to slide and rotate along curved sliding groove.

The elastic member 4 abuts against and locates between the main body 1 and the working portion 2. More particularly, the elastic member 4 is received in the receiving groove 121 of the head portion, and abuts against the working portion 2.

Figure 5:
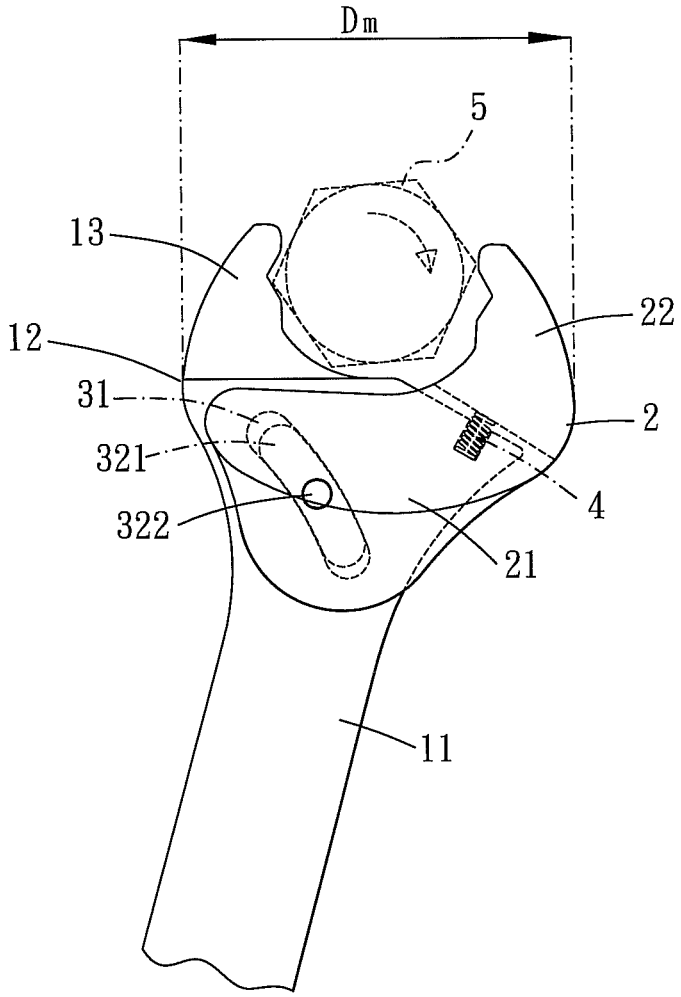
FIG. 5 is a schematic drawing showing using condition of a first embodiment of the present invention.

Accordingly, please refer to FIG. 4 and FIG. 5, the sliding portion is able to slide along the sliding groove 31. The sliding portion is firmly disposed on the connection arms 21 of the working portion. Thus, the working portion 2 can slide along the arc-shaped sliding groove 31 together with the sliding portion. The working portion 2 can slide between a first position and a second position.

Refer to FIG. 4, the opening defines a width direction. When the working portion is located at the first position, the opening is used for clamping a threaded member 5 therein. Two opposite ends of the working portion 2, the fixed jaw 13, and the head portion 12 has an initial width Do therebetween.

Refer to FIG. 5, the working portion 2 is able to slide along the sliding groove 31 toward the second position. The threaded member 5 can escape from the fixed jaw 13 and the movable jaw 22 so as to rotate in the opening arbitrarily. Two opposite ends of the working portion 2, the fixed jaw 13, and the head portion 12 has a maximum width Dm therebetween. Preferably, subtraction of the maximum width Dm and the initial width Do is smaller than tan percent of the initial width Do. Thus, in an operation condition, the threaded member 5 can escape from the opening without overly movement of the working portion 2. When user pulls the wrench in an opposite direction, the opening can clamp the threaded member 5 immediately so as to fasten or detach the threaded member 5 easily. Further, the wrench is suitable for operating in narrowed space since motion of the working portion 2 is minified by employing the arc-shaped sliding groove.

Please refer to FIG. 4. The elastic member 4 abuts against the working portion 2, so that the working portion 2 has a tendency to slide toward the first position. The working portion 2 would slide to the first position when the working portion 2 is released from external force. The connection arms 21 would abut against the step surfaces. Width of two opposite ends of the working portion 2, the fixed jaw 13, and the head portion 12 is then return to the initial width Do.

In the present embodiment, the sliding groove 31 is formed on the head portion 12. The sliding portion is firmly disposed on the connection arms 21. In other possible embodiments of the present invention, position of the sliding groove 31 and position of the sliding portion may be interchanged. The sliding groove may be formed on the connection arms, and the sliding portion may be firmly disposed on the head portion. In addition, in the embodiment, the fixation holes of the connection arms should be removed, and the head portion should be formed with the corresponding fixation hole. Thus, the sliding portion can be assembled on or attached to the head portion by fabrication or other manners.

Figure 6:
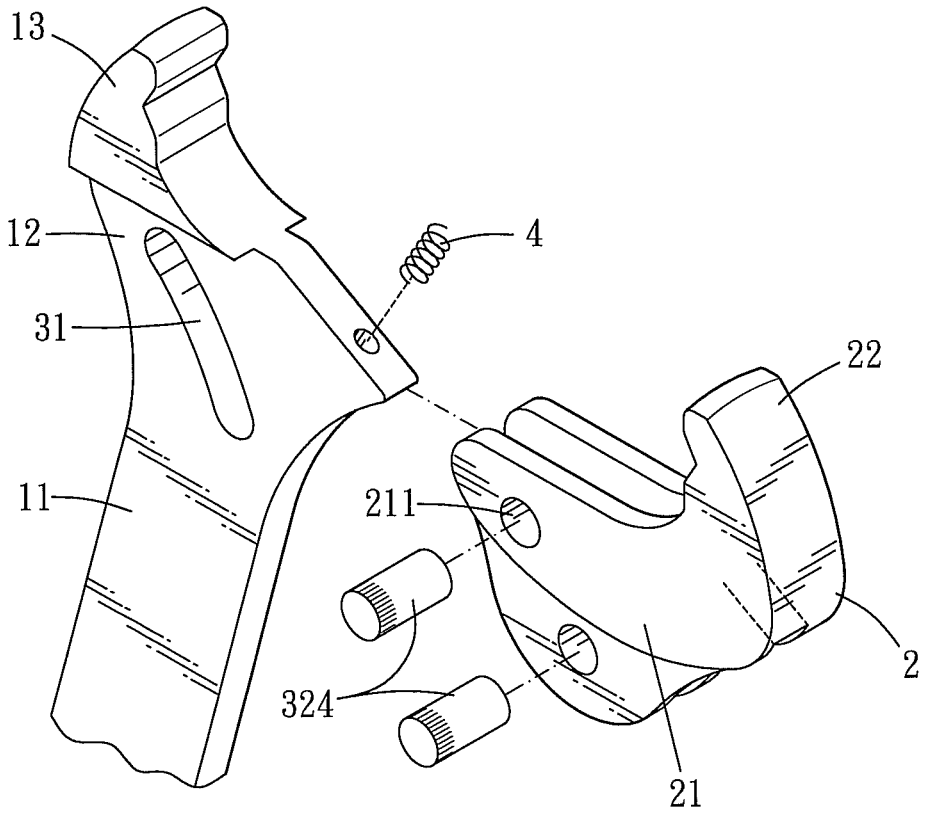
FIG. 6 is a breakdown drawing showing a second embodiment of the present invention.
Figure 8:
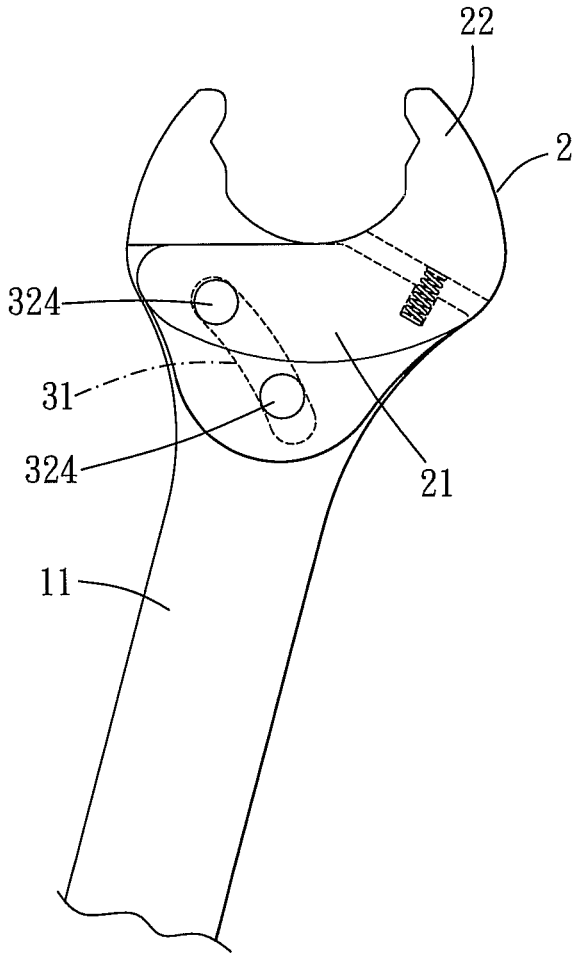
FIG. 8 is a front view showing a second embodiment of the present invention.
Figure 7:
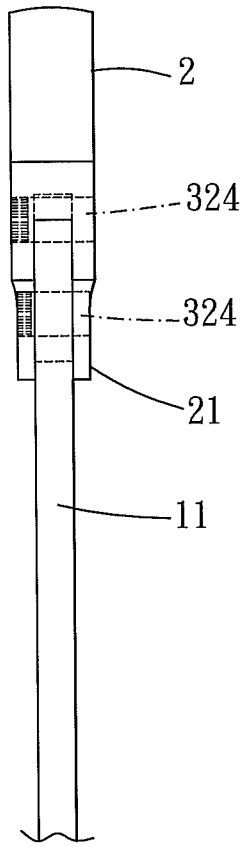
FIG. 7 is a side view showing a second embodiment of the present invention.
Figure 9:
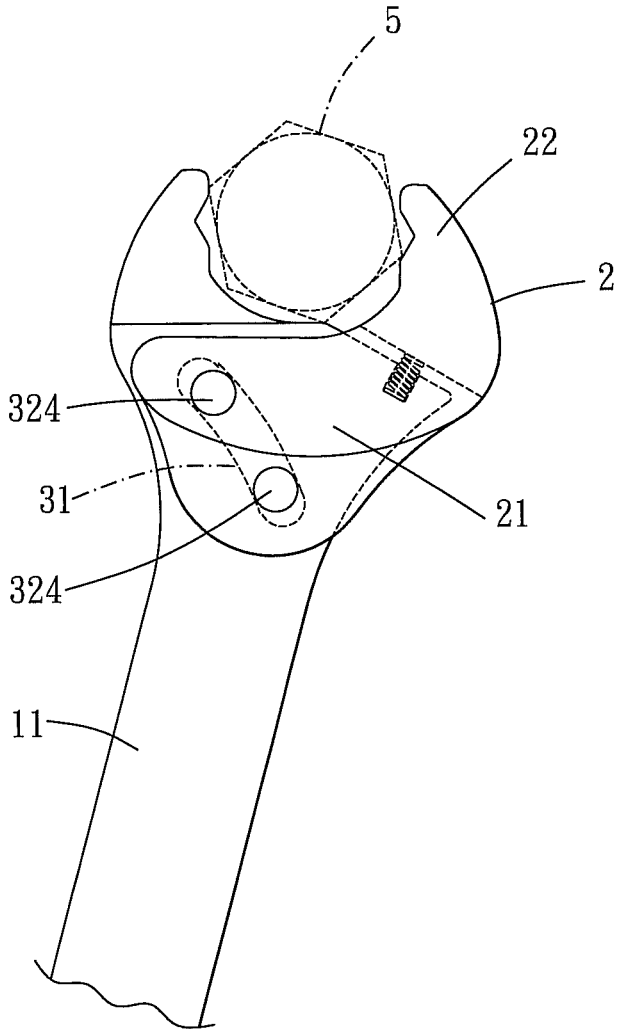
FIG. 9 is a schematic drawing showing using condition of a second embodiment of the present invention.

Please refer to FIG. 6 to FIG. 8. In a second embodiment of the present invention, structure of the wrench is approximately similar to the wrench of the first embodiment. The sliding portion is replaced with two pins 324. Each of the connection arms 21 is formed with two fixation holes 211. Each of the pins 324 penetrates through the sliding groove 31 and is received in two corresponding fixation holes 211 which are located on the connection arms respectively. The pins 324 are able to slide along the sliding groove 31. Thus, the working portion 2 is still able to slide along the arc-shaped sliding groove 31 between the first position and the second position, as shown in FIG. 8 and FIG. 9. In the present embodiment, the pin 324 may has circular cross sections respectively; even so, the cross section of the sliding portion is still non-circular since each of the pins 324 is regarded as only a part of the sliding portion. The working portion 2 is still unable to slide in the sliding groove 31 arbitrarily. Thus, in the present embodiment, whether each of the pins 324 is able to rotate is not limited. As such, the structure of the wrench is further simplified in the second embodiment.

In view of foregoing, the wrenches of the present embodiments have simplified structures. It is noted that arc-shaped abutting surface is dismissed, and only arc-shaped groove which can be manufactured easily is retained. The components are suitable for machining and processing. Producing processes, such as machining, folding, casting, and pressing, can be chosen as the main producing process. As such, cost, precision, and structure strength can be managed well.

What is claimed is:

1. A ratchet-action open-end wrench, comprising:

a main body, having a handle, at least a head portion, and a fixed jaw, the head portion being connected to one end of the handle, the fixed jaw extending and protruding out from the head portion;

a working portion, having at least a connection arm and a movable jaw, the connection arm abutting against the head portion, an opening being defined by the movable jaw and the fixed jaw;

a slidable mechanism, comprising a sliding groove and a sliding portion, the sliding groove being formed on the head portion, the sliding portion comprising a sliding member slidably received in the sliding groove and a fixing pin penetrating through the sliding member and fixed on the connection arm, so that the working portion is able to slide along the sliding groove with respect to the main body, the working portion being slidable between a first position and a second position, a width of the opening being minified when the working portion slides toward the first position, the sliding groove being arc-shaped, an arc center of the sliding groove being located out of the head portion, the arc center and the movable jaw being located at opposite sides divided by the main body, the main body being located between the movable jaw and the arc center of the sliding groove the sliding member having an elongated non-circular cross section, so that the sliding portion is unable to rotate in the sliding groove arbitrarily;

an elastic member, abutting against the main body and the working portion, so that the working portion has a tendency to slide toward the first position.

2. The ratchet-action open-end wrench of claim 1, wherein the working portion has two connection arms, the connection arms abut against the head portion, the head portion is located between the two connection arms, and the sliding groove is formed on the head portion.

3. The ratchet-action open-end wrench of claim 2, wherein a thickness of the fixed jaw is greater than a thickness of the head portion, the main body is formed with a step surface, the step surface is located between the fixed jaw and the head portion, the connection arm abuts against the step surface when the working portion is located at the first position.

4. The ratchet-action open-end wrench of claim 3, wherein each of the fixed jaw and the movable jaw is formed with a recess, the recesses are facing each other for clamping corners of a polygonal column.

5. The ratchet-action open-end wrench of claim 3, wherein the opening defines a width direction; when the working portion is located at the first position, the opening is adapted for a threaded member to be clamped therein, and two opposite ends of the working portion, the fixed jaw and the head portion has an initial width therebetween; when the working portion slides toward the second position, and the threaded member which is located between the fixed jaw and the movable jaw is able to rotate arbitrarily, two opposite ends of the working portion, the fixed jaw and the head portion has a maximum width; and subtraction of the maximum width and the initial width is smaller than tan percent of the initial width.

6. The ratchet-action open-end wrench of claim 2, wherein each of the fixed jaw and the movable jaw is formed with a recess, the recesses are facing each other for clamping corners of a polygonal column.

7. The ratchet-action open-end wrench of claim 2, wherein the opening defines a width direction; when the working portion is located at the first position, the opening is adapted for a threaded member to be clamped therein, and two opposite ends of the working portion, the fixed jaw and the head portion has an initial width therebetween; when the working portion slides toward the second position, and the threaded member which is located between the fixed jaw and the movable jaw is able to rotate arbitrarily, two opposite ends of the working portion, the fixed jaw and the head portion has a maximum width; and subtraction of the maximum width and the initial width is smaller than tan percent of the initial width.

8. The ratchet-action open-end wrench of claim 1, wherein a thickness of the fixed jaw is greater than a thickness of the head portion, the main body is formed with at least one step surface, the step surface is located between the fixed jaw and the head portion, the connection aim abuts against the step surface when the working portion is located at the first position.

9. The ratchet-action open-end wrench of claim 8, wherein each of the fixed jaw and the movable jaw is formed with a recess, the recesses are facing each other for clamping corners of a polygonal column.

10. The ratchet-action open-end wrench of claim 8, wherein the opening defines a width direction; when the working portion is located at the first position, the opening is adapted for a threaded member to be clamped therein, and two opposite ends of the working portion, the fixed jaw and the head portion has an initial width therebetween; when the working portion slides toward the second position, and the threaded member which is located between the fixed jaw and the movable jaw is able to rotate arbitrarily, two opposite ends of the working portion, the fixed jaw and the head portion has a maximum width; and subtraction of the maximum width and the initial width is smaller than tan percent of the initial width.

11. The ratchet-action open-end wrench of claim 1, wherein each of the fixed jaw and the movable jaw is formed with a recess, the recesses are facing each other for clamping corners of a polygonal column.

12. The ratchet-action open-end wrench of claim 1, wherein the opening defines a width direction; when the working portion is located at the first position, the opening is adapted for a threaded member to be clamped therein, and two opposite ends of the working portion, the fixed jaw and the head portion has an initial width therebetween; when the working portion slides toward the second position, and the threaded member which is located between the fixed jaw and the movable jaw is able to rotate arbitrarily, two opposite ends of the working portion, the fixed jaw and the head portion has a maximum width; and subtraction of the maximum width and the initial width is smaller than tan percent of the initial width.

13. A ratchet-action open-end wrench, comprising:

a main body, having a handle, at least a head portion, and a fixed jaw, the head portion being connected to one end of the handle, the fixed jaw extending and protruding out from the head portion;

a working portion, having at least a connection arm and a movable jaw, the connection arm abutting against the head portion, an opening being defined by the movable jaw and the fixed jaw;

a slidable mechanism, comprising a sliding groove and a sliding portion, the sliding groove being formed on the head portion, the sliding portion being firmly disposed on the connection arm, the sliding portion being slidably disposed on the sliding groove, so that the working portion is able to slide along the sliding groove with respect to the main body, the working portion being slidable between a first position and a second position, a width of the opening being minified when the working portion slides toward the first position, the sliding groove being arc-shaped, an arc center of the sliding groove being located out of the head portion, the arc center and the movable jaw being located at opposite sides divided by tile main body, the main body being located between the movable jaw and the arc center of the sliding groove;

an elastic member, abutting against the main body and the working portion, so that the working portion has a tendency to slide toward the first position;

wherein the working portion has two connection arms, the connection arms abut against the head portion, the head portion is located between the two connection arms, each of the connection arms is formed with two fixation holes, the sliding portion comprises two pins, each of the pins penetrates through the sliding groove and is received in two corresponding fixation holes which are located on the connection arms respectively, and the pins are able to slide along the sliding groove so that the sliding portion is unable to rotate in the sliding groove arbitrarily.

14. The ratchet-action open-end wrench, of claim 13, wherein a thickness of the fixed jaw is greater than a thickness of the head portion, the main body is formed with a step surface, the step surface is located between the fixed jaw and the head portion, the connection arm abuts against the step surface when the working portion is located at the first position.

15. The ratchet-action open-end wrench of claim 14, wherein each. of the fixed jaw and the movable jaw is formed with a recess, the recesses are facing each other for clamping corners of a polygonal column.

16. The ratchet-action open-end wrench of claim 14, wherein the opening defines a width direction; when the working portion is located at the first position, the opening is adapted for a threaded member to be clamped therein, and two opposite ends of tile working portion, the fixed jaw and the head portion has an initial width therebetween; when the working portion slides toward the second position, and the threaded member which is located between the fixed jaw and the movable jaw is able to rotate arbitrarily, two opposite ends of the working portion, the fixed jaw and the head portion has a maximum width; and subtraction of the maximum width and the initial width is smaller than tan percent of the initial width.

17. The ratchet-action open-end wrench of claim 13, wherein each of the fixed jaw and the movable jaw is formed with a recess, the recesses are facing each other for clamping corners of a polygonal column.

18. The ratchet-action open-end wrench of claim 13, wherein the opening defines a width direction; when the working portion is located at the first position, the opening is adapted for a threaded member to be clamped therein, and two opposite ends of the working portion, the fixed jaw and the head portion has an initial width therebetween; when the working portion slides toward the second position, and the threaded member which is located between the fixed jaw and the movable jaw is able to rotate arbitrarily, two opposite ends of the working portion, the fixed jaw and the head portion has a maximum width; and subtraction of the maximum width and the initial width is smaller than tan percent of the initial width.

* * * * *